US011317724B2

(12) United States Patent
Vang et al.

(10) Patent No.: US 11,317,724 B2
(45) Date of Patent: May 3, 2022

(54) LOUNGE FURNITURE WITH REMOVABLE SEAT

(71) Applicant: Krueger International, Inc., Green Bay, WI (US)

(72) Inventors: Xeng Xue Vang, Green Bay, WI (US); Scott J. Williams, Green Bay, WI (US); Dennis Gordon Griepentrog, De Pere, WI (US); Scott Anthony Bosman, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 17/172,341

(22) Filed: Feb. 10, 2021

(65) Prior Publication Data

US 2021/0267377 A1 Sep. 2, 2021

Related U.S. Application Data

(60) Provisional application No. 62/983,988, filed on Mar. 2, 2020.

(51) Int. Cl.

| | |
|---|---|
| ***A47C 17/02*** | (2006.01) |
| ***A47C 7/72*** | (2006.01) |
| ***A47C 3/16*** | (2006.01) |

(52) U.S. Cl.

CPC ..... *A47C 17/02* (2013.01); *A47C 3/16* (2013.01); *A47C 7/72* (2013.01)

(58) Field of Classification Search

CPC .. A47C 7/72; A47C 7/62; A47C 17/02; A47C 17/04; A47C 3/16

USPC ..... 297/232

See application file for complete search history.

(56) References Cited

U.S. PATENT DOCUMENTS

| | | | | |
|---|---|---|---|---|
| 3,171,685 | A | 3/1965 | Hershberger et al. | |
| 10,524,580 | B1 | 1/2020 | Bongaerts et al. | |
| 2008/0164742 | A1* | 7/2008 | Crowe | A47C 4/02 297/440.14 |
| 2009/0001775 | A1* | 1/2009 | Smith | A47B 83/02 297/135 |
| 2017/0214197 | A1* | 7/2017 | Suri | A47B 97/00 |
| 2018/0041354 | A1* | 2/2018 | Nelson | A47C 7/723 |
| 2019/0099005 | A1* | 4/2019 | Decker | A47C 7/628 |
| 2020/0100030 | A1* | 3/2020 | Nelson | H04R 1/025 |

(Continued)

*Primary Examiner* — Mark R Wendell

(74) *Attorney, Agent, or Firm* — Andrus Intellectual Property Law, LLP

(57) ABSTRACT

Electrified lounge furniture formed from joined furniture sections. Each furniture section includes a lounge back, a seat and a base. The seat is designed to be selectively pivotable away from the base. When the furniture sections are joined to each other, an electrical wiring assembly extends between the furniture sections to provide electrical power to each of the furniture sections. Each of the furniture sections includes at least one electrical outlet. The electrical wiring assembly is received on the base of each of the furniture sections and is concealed beneath the seat during normal usage. When the user desires access to the electrical wiring assembly, one or more of the seats can pivot away from the base to provide access to the electrical wiring assembly. After the electrical wiring assembly has been accessed, the seat can pivot back into contact with the base where it is securely held to both the base and the lounge back.

19 Claims, 15 Drawing Sheets

(56) References Cited

U.S. PATENT DOCUMENTS

| | | | | |
|---|---|---|---|---|
| 2020/0221227 | A1* | 7/2020 | Nelson | A47C 7/727 |
| 2021/0112341 | A1* | 4/2021 | Nelson | A47C 7/72 |

* cited by examiner

LOUNGE FURNITURE WITH REMOVABLE SEAT

CROSS REFERENCE TO RELATED APPLICATION

The present application is based on and claims priority to U.S. Provisional Patent Application Ser. No. 62/983,988 filed Mar. 2, 2020, the disclosure of which is incorporated herein by reference.

BACKGROUND

The present disclosure generally relates to lounge furniture. More specifically, the present disclosure relates to lounge furniture formed from joined furniture sections that each have seats that can pivot relative to a lounge back to provide access to electrical wiring extending between the furniture sections.

SUMMARY

The present disclosure relates to a piece of lounge furniture. More specifically, the present disclosure relates to a piece of lounge furniture that is formed from joined, separate furniture sections that can be assembled and connected both physically and electrically to create the piece of lounge furniture.

The lounge furniture of the present disclosure includes a plurality of furniture sections that each include a lounge back, a seat and a base. The plurality of lounge furniture sections can be joined to each other in user selected configurations to create the piece of lounge furniture. The lounge back and seat of each furniture section are designed to comfortably receive a user such that the user can be supported on the lounge furniture.

The base of each furniture section is designed to receive both the lounge back and the seat. The seat is designed such that a back end of the seat can be selectively pivoted away from the base and the lounge back. During use, the seat is securely retained on the base and the back end of the seat is secured to the lounge back to restrict the pivoting movement of the seat. When desired, the back end of the seat can be pivoted away from the lounge back such that a user has access to the base without having to completely disassemble the lounge furniture.

Each of the furniture sections includes at least one electrical outlet that is associated with the furniture section. In one contemplated embodiment, the electrical outlet is positioned along a front wall of the seat such that the electrical outlet is accessible from the front of the furniture section. In an alternate, contemplated embodiment, one or more electrical outlets could be accessible from a backside of the lounge back.

In addition to the electrical outlet, each of the plurality of furniture sections includes electrical wiring that allows adjacent furniture sections to be electrically connected to each other. Specifically, an electrical wiring assembly for the lounge furniture is designed to extend between the furniture sections to connect each of the electrical outlets of the lounge furniture. The electrical wiring assembly is designed to be received on the base of each of the plurality of furniture sections. When the seat is in its use position, the electrical wiring assembly extending between and electrically connecting the furniture sections is concealed beneath the seats of the furniture sections.

During assembly of the lounge furniture, each of the seats is either completely removed from the base or is pivoted upward away from the base to provide access to the electrical wiring assembly. Once the electrical wiring assembly is completely connected between the electrical outlets and a main power supply, the seat of each furniture section can be pivoted back into the usage position. In the usage position, the seat of each furniture section conceals the electrical wiring assembly.

In one contemplated embodiment of the present disclosure, each seat can include at least one front seat hook that engages a front seat catch on the base to securely hold the front end of the seat in its usage position. A back end of the seat includes an access opening that receives at least one seat hook that is mounted to the lounge back. The interaction between the at least one seat hook and the access opening allows the seat to pivot away from the base while the front seat hook remains engaged with the base. In this manner, the seat can be pivoted into an access position to provide access to the electrical wiring assembly interconnecting the joined furniture sections.

In another contemplated embodiment, at least one base ganger is used to connect adjacent bases of the furniture sections such that the adjacent furniture sections remain fixed relative to each other. In another contemplated embodiment, at least one backrest ganger can also be used to secure the lounge backs of adjacent furniture sections to each other in the assembled condition. Through the use of the base gangers and backrest gangers, the adjacent furniture sections can be securely held in place once the lounge furniture is assembled.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
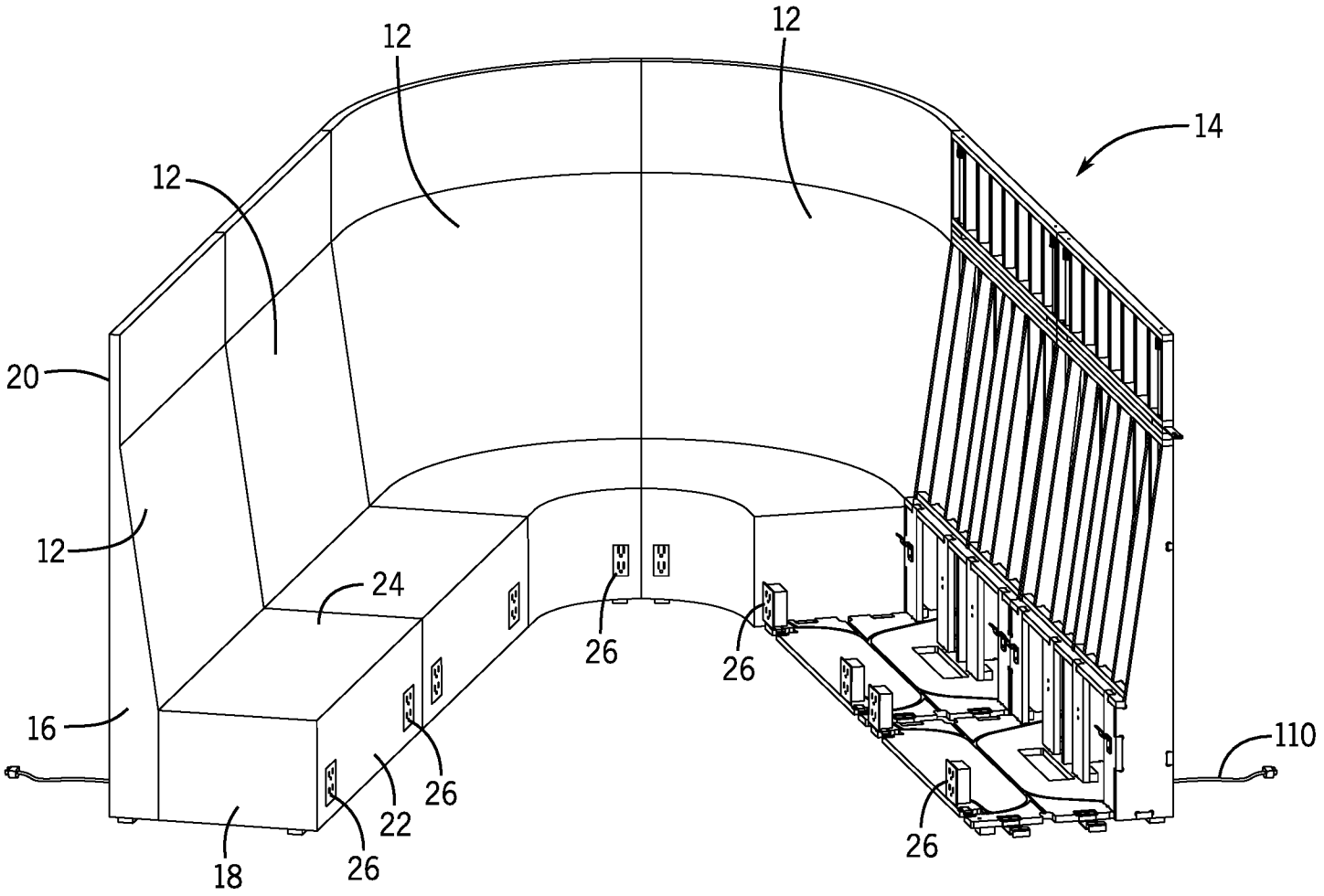
FIG. 1 is a front perspective view of multiple lounge furniture sections joined to each other to create a piece of lounge furniture.
Figure 2:
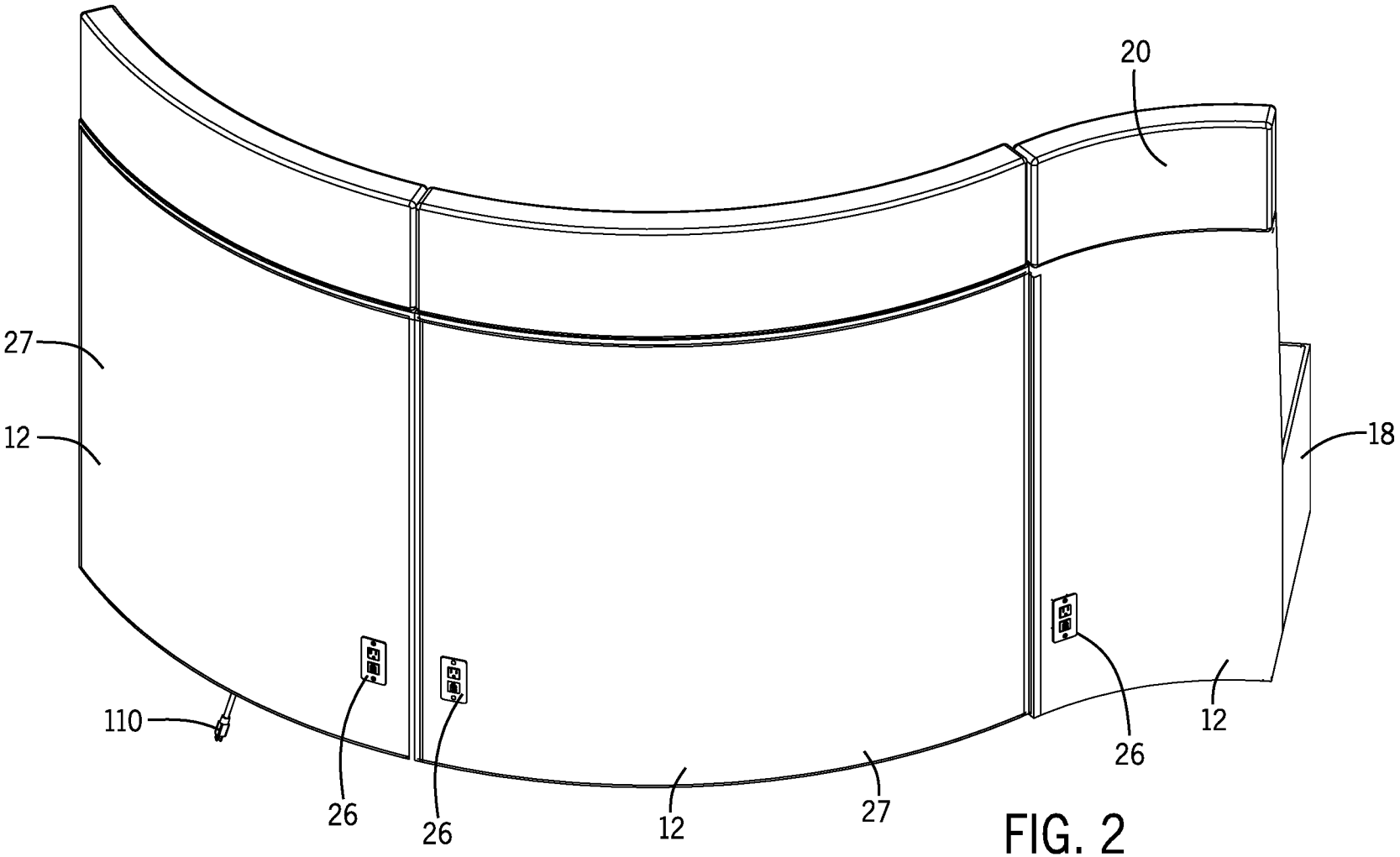
FIG. 2 is a rear perspective view of multiple lounge furniture sections joined in a second exemplary embodiment of the present disclosure.

FIG. 1 illustrates a plurality of furniture sections 12 that are shown joined together to form a complete piece of lounge furniture 14. In the embodiment shown in FIG. 1, the furniture sections 12 include four straight furniture sections and a pair of curved furniture sections that define a generally U-shape for the lounge furniture 14. However, it is contemplated that various different combinations of the furniture sections 12 could be utilized while operating within the scope of the present disclosure. A second illustrative example is shown in FIG. 2 in which the furniture sections 12 are joined in a contemplated, second configuration. Although two examples of the completed lounge furniture are shown, it should be understood that a variety of configurations for the lounge furniture could be created while operating within the scope of the present disclosure.

In the embodiment shown in FIG. 1, each of the furniture sections 12 includes a lounge back 16 and a seat 18. Both the lounge back 16 and the seat 18 can include padding on the surface that contact the user when lounge furniture is in the usage condition and the user is seated on one of the furniture sections 12. In the embodiment shown in FIG. 1, the lounge back 16 includes a topper section 20 mounted to the upper end of the lounge back 16 to enhance the decorative appearance of the lounge furniture and to increase the overall height of the lounge furniture 14. The increased height creates additional privacy for users seated on one of the furniture sections 12 of the lounge furniture 14.

As can be seen in FIG. 1, each of the seats 18 includes a front face 22 and a generally horizontal seating surface 24. The seating surface 24 can include padding for the comfort of the user. The front face 22 of each of the straight furniture sections shown in FIG. 1 can include one or more electrical outlets 26 that are accessible by the user from the front face 22. Each of the curved furniture sections 12 include a single electrical outlet 26, although different numbers of outlets 26 are contemplated as being within the scope of the present disclosure. In the second contemplated embodiment shown in FIG. 2, the curved furniture sections are designed to also include electrical outlets along the back surface 27. The back surface 27 is opposite the location of the seat 18 and the inclusion of the outlets 26 along the back surface 27 increases the flexibility of use for the lounge furniture.

The electrical outlets 26 provide a convenient place for a user to plug in an electrical device when the user is seated on the lounge furniture 14. In accordance with the present disclosure, an electrical wiring assembly that creates the electrical connections between the adjacent lounge furniture sections 12 is located below the seats 18 and is thus concealed when the lounge furniture is in the usage condition. In the view shown in FIG. 1, a pair of the seats 18 are removed from the two right-most furniture sections 12 to show the electrical wiring assembly that extends between the electrical outlets 26 of the adjacent furniture sections 12. Further details of the electrical wiring assembly and the connections between the electrical outlets 26 will be described in greater detail below.

Figure 3:
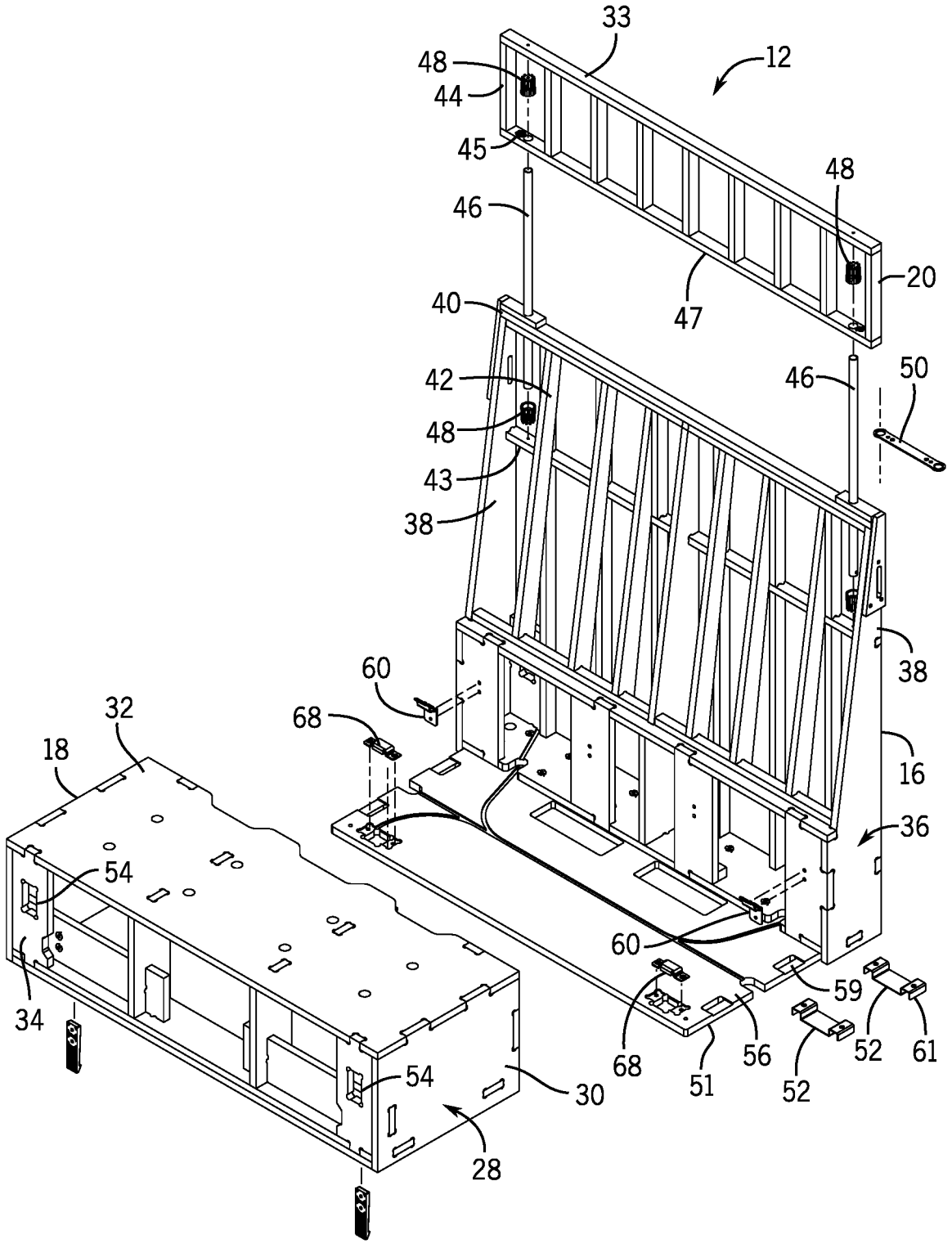
FIG. 3 is an exploded perspective view of one of the lounge furniture sections.
Figure 4:
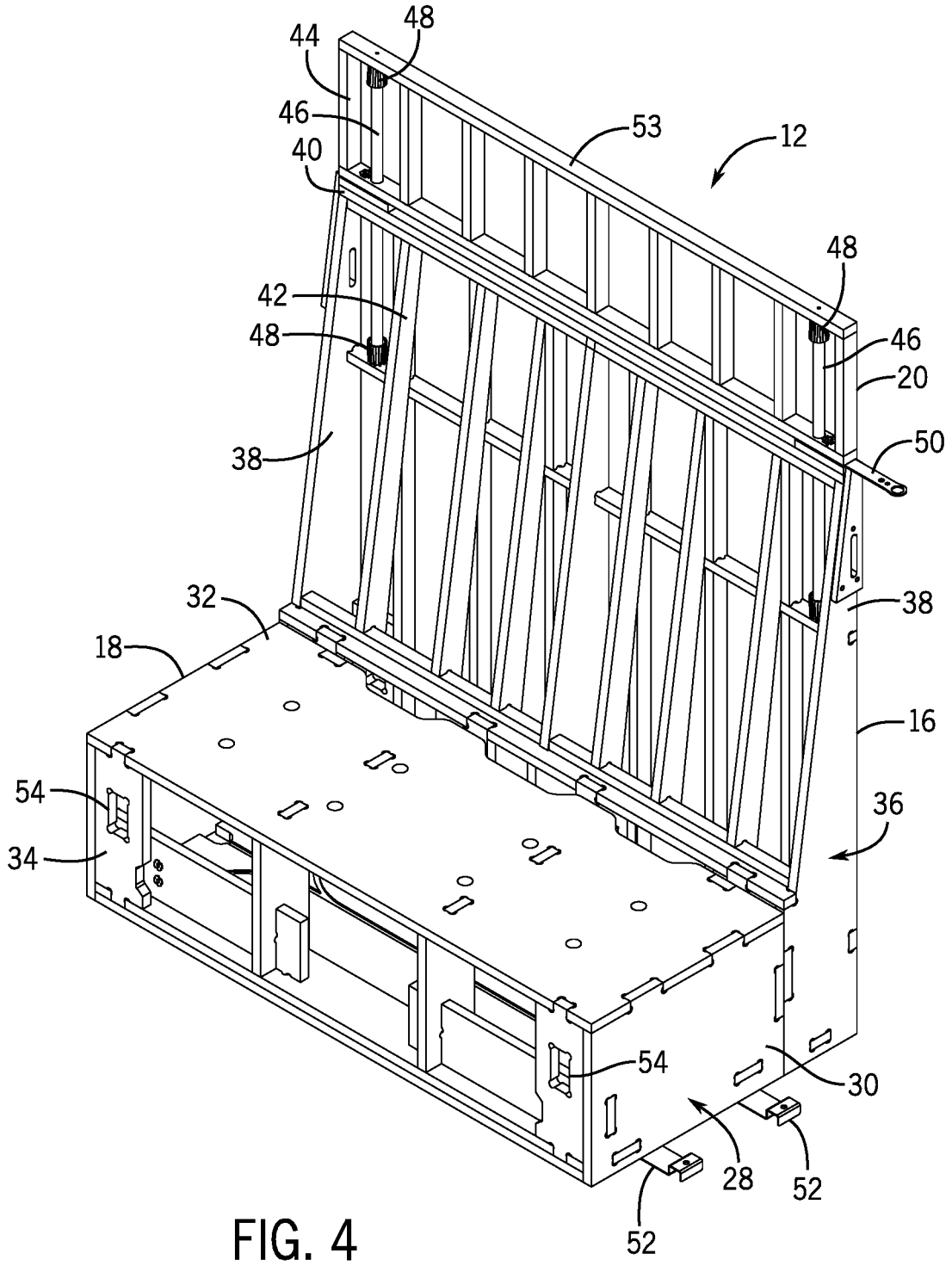
FIG. 4 is a perspective view of one of the lounge furniture sections with the outer portion removed to show the frame.

FIGS. 3 and 4 illustrate one of the lounge furniture sections 12 with the decorative outer coverings removed from both the lounge back 16 and the seat 18. Further, the outer decorative covering for the topper section 20 has also been removed to show the internal construction of the topper section 20. As illustrated in FIGS. 3 and 4, the seat 18 includes a seat frame 28 that includes a pair of side panels 30, a top panel 32 and a front wall assembly 34. In the embodiment illustrated, the pair of side panels 30, the top panel 32 and the front wall assembly 34 are all formed from a wooden material joined to each other utilizing one of various different types of connection techniques. However, it is contemplated that other durable, sturdy materials, such as a fiber reinforced plastic, could be used in place of wood to create the seat frame 28.

The lounge back 16 shown in FIGS. 3 and 4 also includes a back frame 36 that includes a pair of side panels 38 connected between a base 56 and a top beam 40. A series of structural supports 42 are spaced between the side panels 38 to provide additional support for the padding that contacts a user when the user is seated on the lounge furniture section 12. As with the seat frame 28, the back frame is also constructed from wood in the shown embodiment, although other durable materials could be used while operating within the scope of the present disclosure. The spacing between the structural supports 42 is selected to provide adequate support for the user and can be varied in different embodiments.

The topper section 20 is shown in FIG. 3 removed from the back frame 36. The topper section 20 includes a topper frame 44 that can be formed from wood or another durable material such as fiber reinforced plastic. The topper frame 44 can be joined to the back frame 36 through a pair of topper support posts 46. Each of the topper support posts 46 extends through an access opening 45 formed in the bottom frame member 47 of the topper frame 44. The first end of the topper support post 46 is received within an alignment cup 48 mounted to a cross support 43 of the back frame 36 while the second end of the topper support post 46 is received within a similar alignment cup 48 mounted along the lower surface of the top frame member 33 of the topper frame 44. The topper support posts 46 provide the required structural stability for the topper section 20 relative to the lounge back 16. In the embodiment shown in FIGS. 3 and 4, a backrest ganger 50 is positioned between the topper frame 44 and the back frame 36. The backrest ganger 50 is used to securely join the top portion of the back frame 36 of adjacent furniture sections 12.

Figure 16:
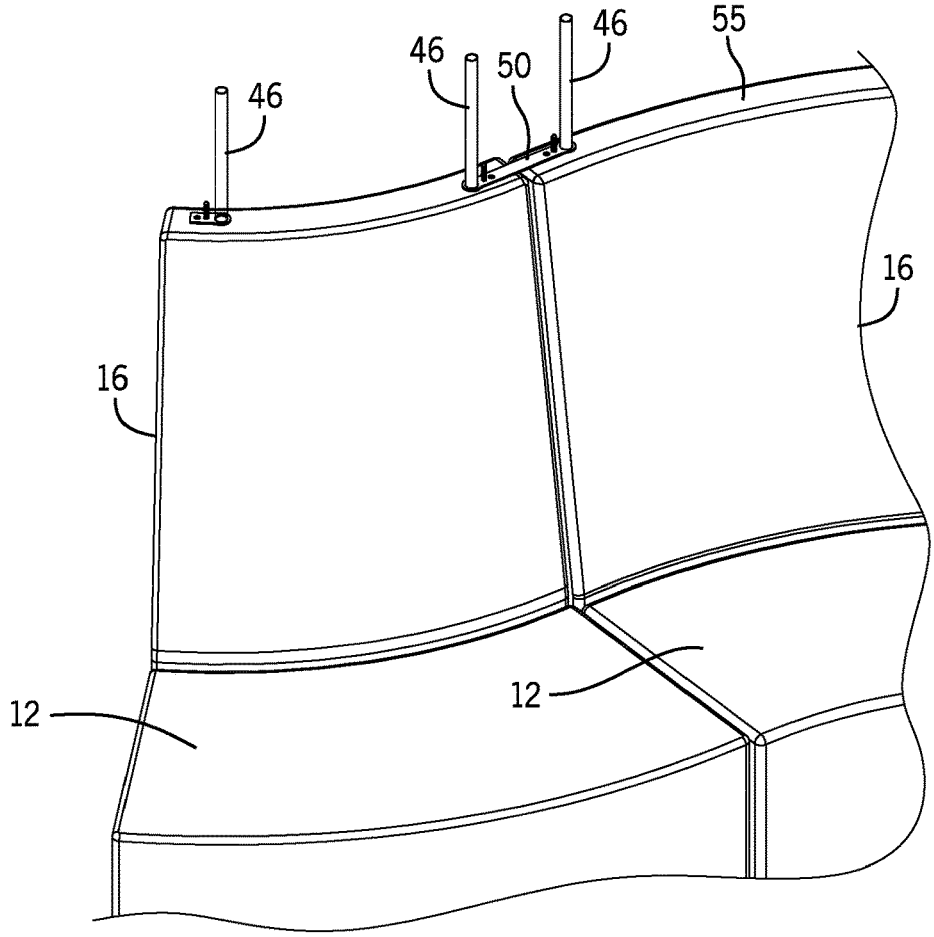
FIG. 16 is a perspective view of a pair of lounge furniture sections joined to each other.
Figure 17:
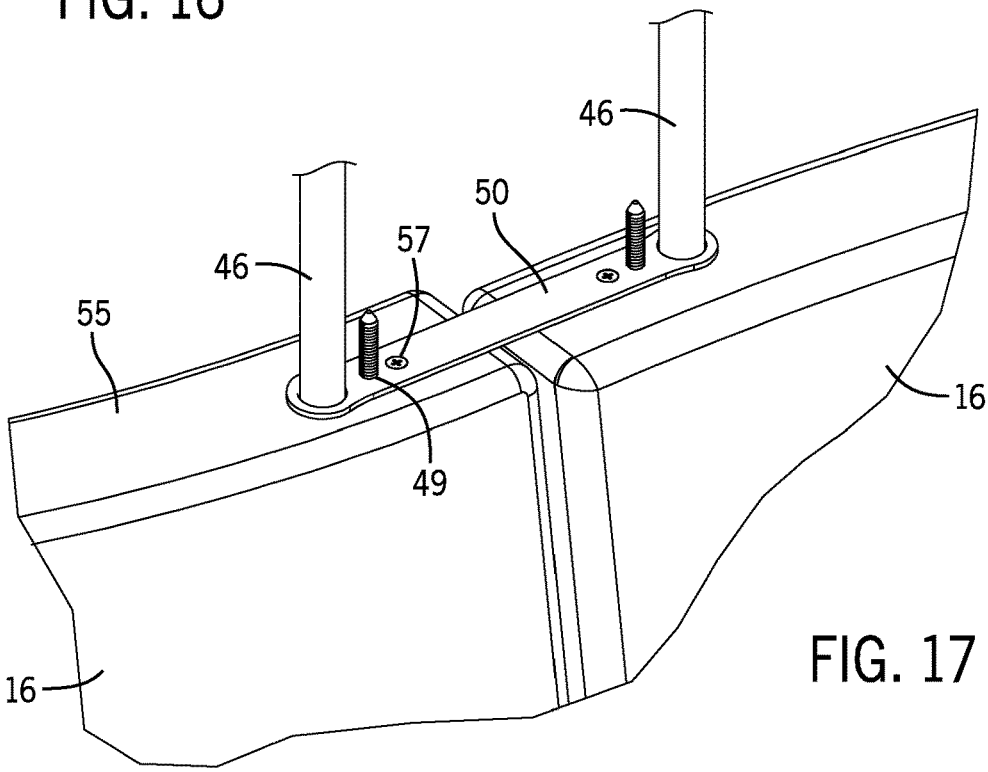
FIG. 17 is a magnified view of a portion of FIG. 16 showing the location of the backrest ganger between two furniture sections.
Figure 18:
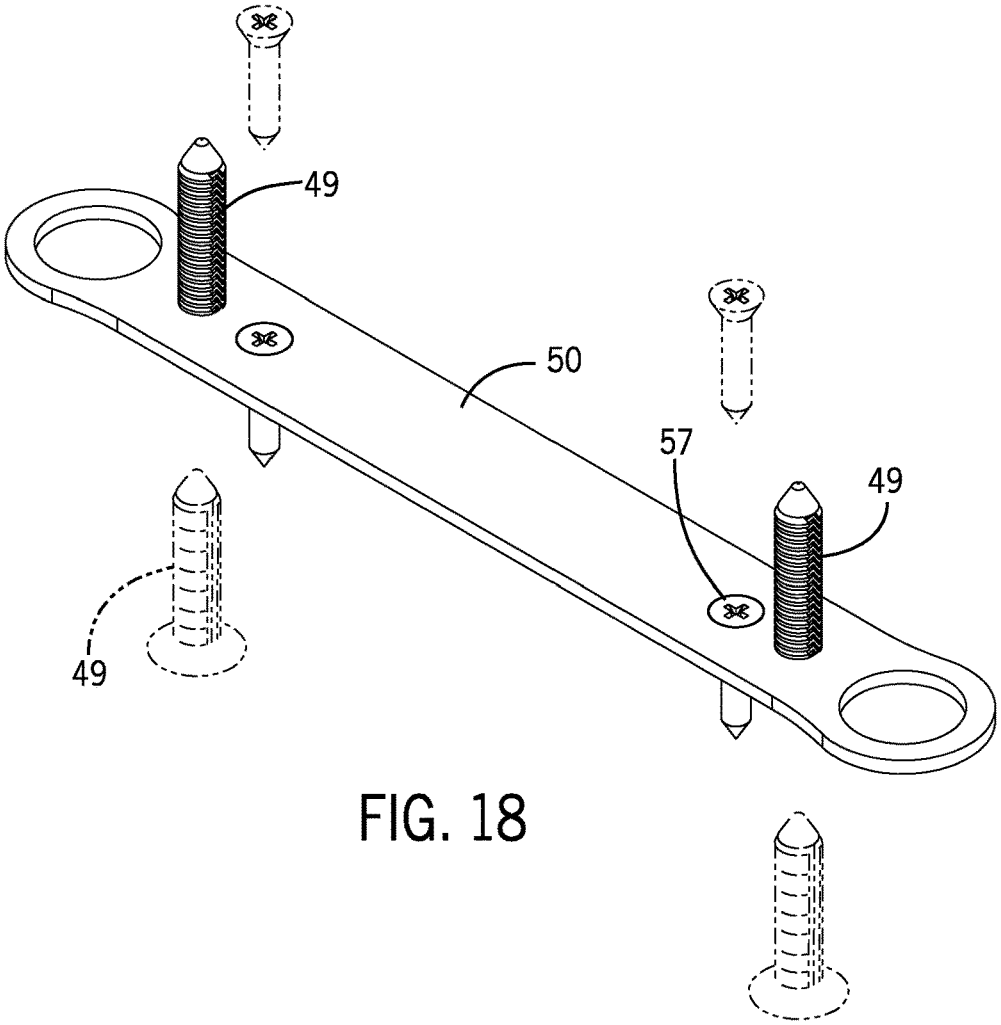
FIG. 18 is a view of the backrest ganger.

FIGS. 16-18 further illustrate the ganging between two of the furniture sections 12 through use of the backrest ganger 50. The backrest ganger 50 is designed to be positioned between the topper support posts 46 of adjacent furniture sections 12. Specifically, the backrest ganger 50 is positioned such that the post opening 53 on each end of the backrest ganger 50 receives one of the two support posts 46 of the adjacent furniture sections 12. The backrest ganger 50 can then slide down into contact with the top surface 55 of the lounge back 16. One or more screw connectors 57 are used to attach the backrest ganger 50 to top beam of each backrest frame. In this manner, the backrest ganger 50 secures the top ends of the lounge backs 16 to each other. As shown in FIG. 18, a pair of friction posts 49 can be used and each extends upward from the backrest ganger 50. The friction posts 49 are used to receive one of the topper frames. The friction posts 49 each include a series of flexible ribs that prevent the removal of the topper frames 44 without the use of some type of pry bar.

Referring back to FIGS. 3 and 4, in addition to the backrest ganger, a pair of base gangers 52 are used to join adjacent furniture sections 12. The combination of the backrest ganger 50 and the base gangers 52 allows adjacent furniture sections to be securely attached to each other during use of the lounge furniture. Specifically, the furniture sections 12 of the present disclosure can be initially set in place, leveled and then ganged to each other using the combination of the backrest gangers 50 and the base gangers 52. Each of the base gangers 52 includes a U-shaped bracket portion 61 on each end that is designed to be received within a cutout 59 formed in the base 56 near the side edge 51. In this manner, the base ganger 52 can join two bases 56 of the adjacent furniture sections 12.

Figure 5:
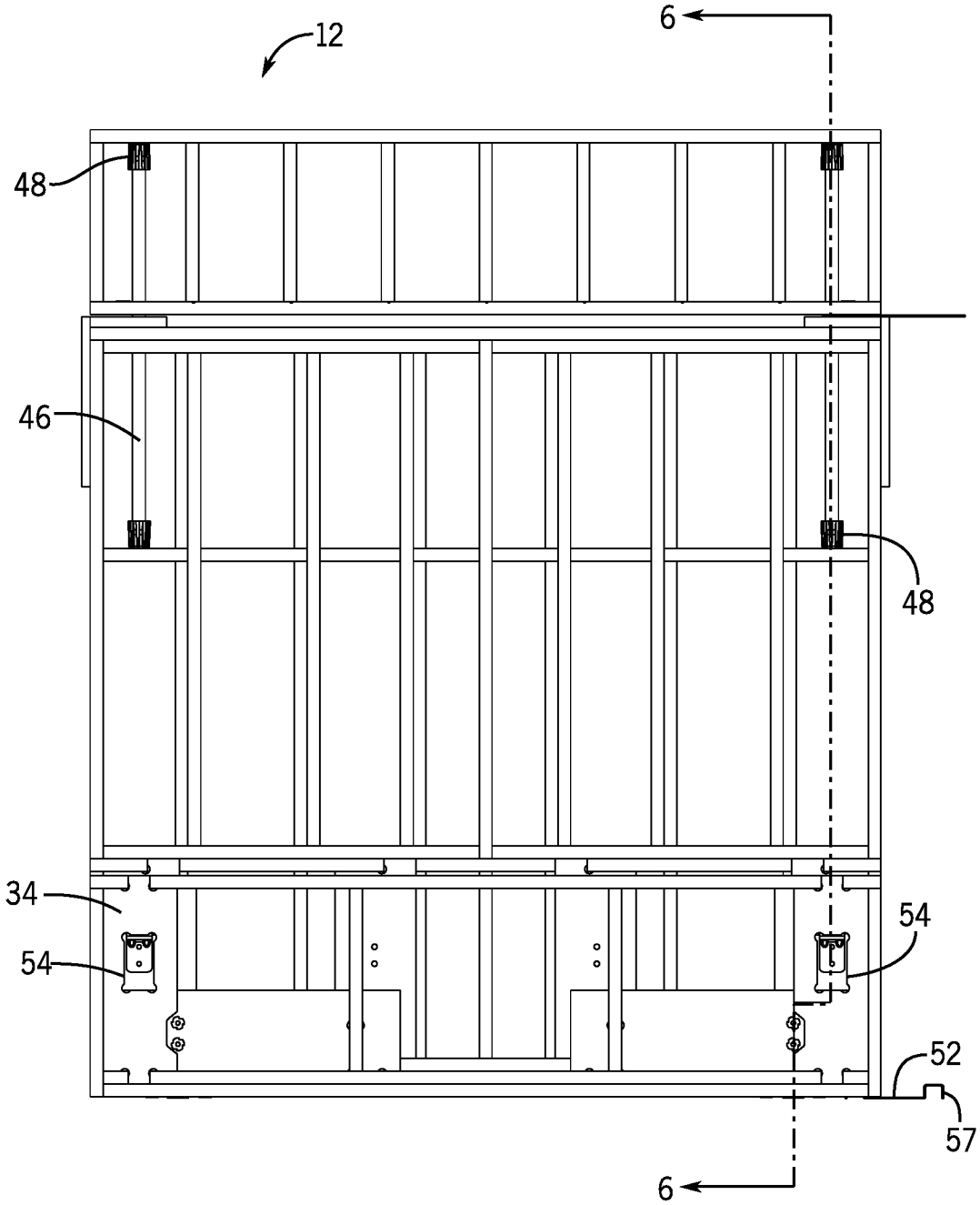
FIG. 5 is front view of the lounge furniture section shown in FIG. 4.

FIG. 5 is a front view of the furniture section 12 shown in FIGS. 3 and 4. As can be seen in the front view of FIG. 5, the front wall assembly 34 of the seat frame 28 includes a pair of cutouts 54 that are designed to receive one of the electrical outlets as previously discussed. The cutouts 54 are each received within a vertically oriented front support such that the electrical outlet can be secured in place for use.

Figure 6:
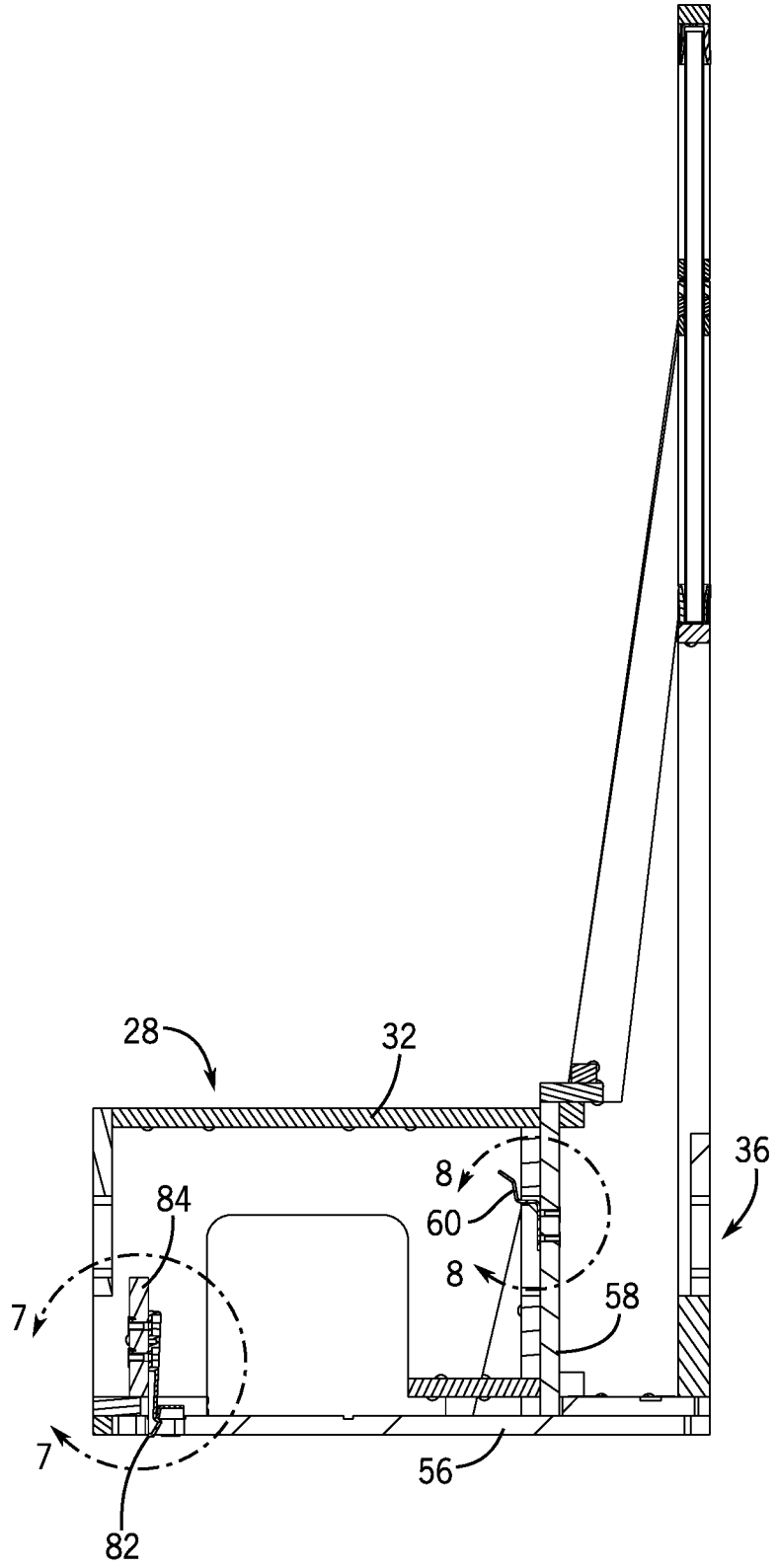
FIG. 6 is a section view taken along line 6-6 of FIG. 5.

FIG. 6 is a section view taken along line 6-6 of FIG. 5 and shows additional details of the back frame 36 and the seat frame 28 when the seat and lounge backs are joined to each other. As illustrated in FIG. 6, the back frame 36 is mounted to the base 56 that is generally horizontal and is designed to be supported on the floor. The base 56 provides a point of attachment for each of the side panels 38 (FIG. 3). In the embodiment illustrated in FIGS. 6 and 10, four separate vertical support walls 58 are included in the back frame 36 and are each attached to the base 56. However, the number of vertical support walls 58 can vary depending on the size of the furniture section and the configuration of the lounge furniture. The vertical support walls 58 provide a point of attachment for the seat frame 28 when the seat frame 28 is mounted to the back frame 36 as will be described in greater detail below.

Figure 10:
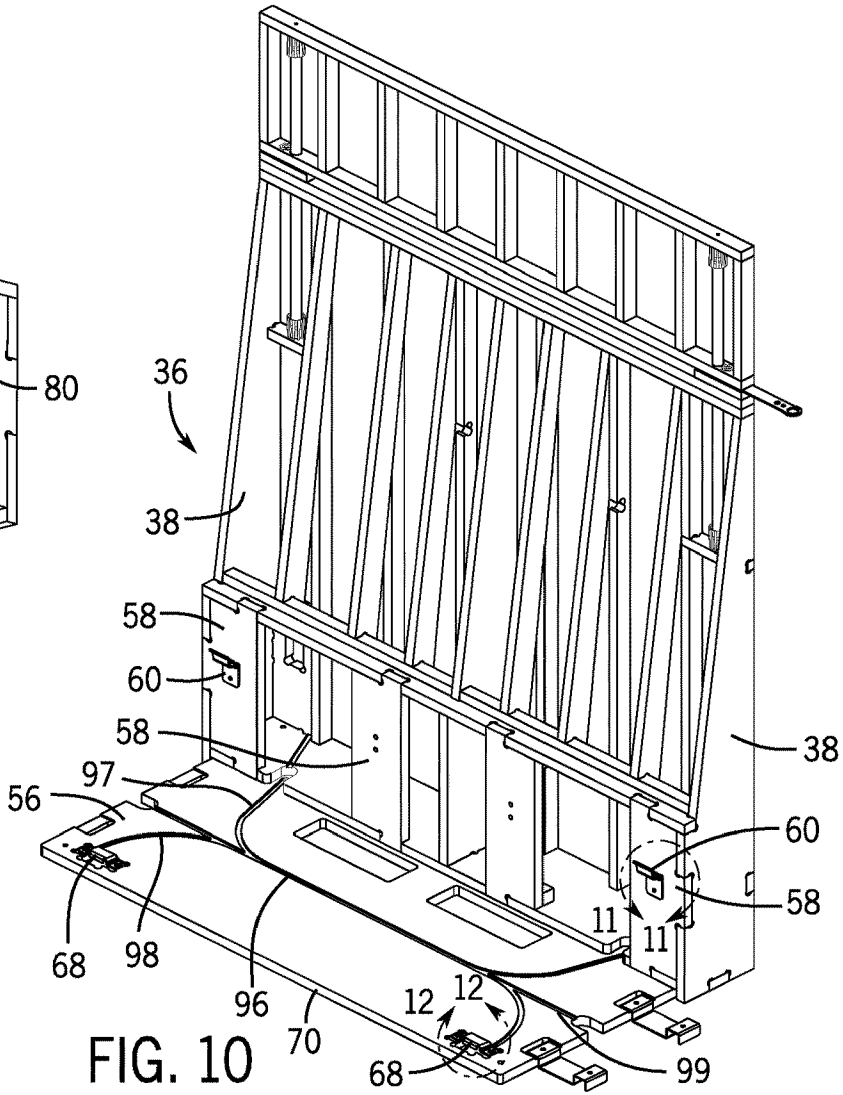
FIG. 10 is a front perspective view of the back frame.
Figure 11:
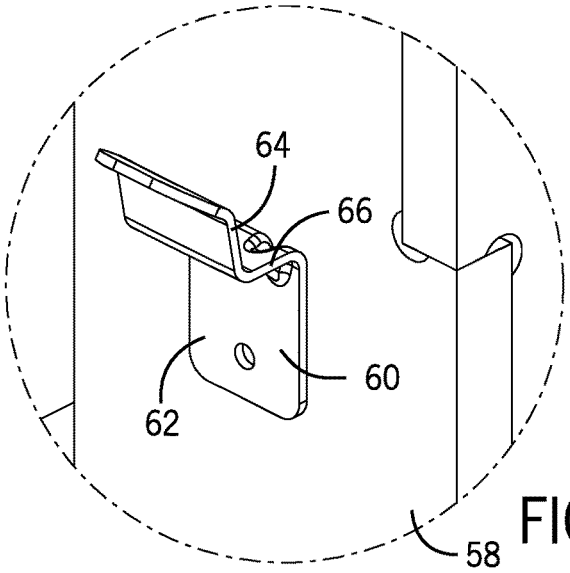
FIG. 11 is a magnified view taken along line 11-11 of FIG. 10.

As can be seen in FIG. 10, the two outermost support walls 58 each include a seat hook 60. The magnified view of FIG. 11 shows the seat hook 60 attached to the support wall 58. In the embodiment shown in FIG. 11, the seat hook 60 includes a vertical attachment portion 62 and an angled engagement portion 64. The engagement portion 64 is separated from the attachment portion 62 by a bend 66 such that the engagement portion 64 is spaced away from the front surface of the support wall 58. Although not shown, a connector is used to secure the seat hook 60 to the support wall 58.

Referring back to FIG. 10, the base 56 further includes a pair of front seat catches 68 mounted near the front edge 70. As can be more clearly seen in FIG. 12, each of the seat catches 68 includes a center portion 72 and a pair of attachment flanges 74. Each seat catch 68 is formed from a metal material and spans across an access channel 76 extending inwardly from a front edge 70 of the base 56.

Figure 7:
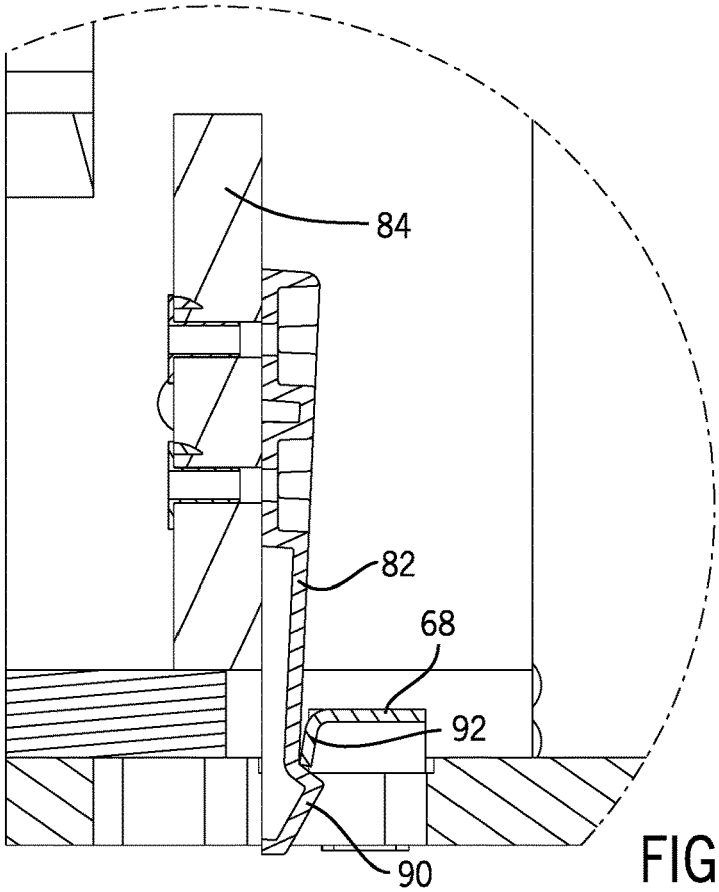
FIG. 7 is a magnified view taken along line 7-7 of FIG. 6.
Figure 7A:
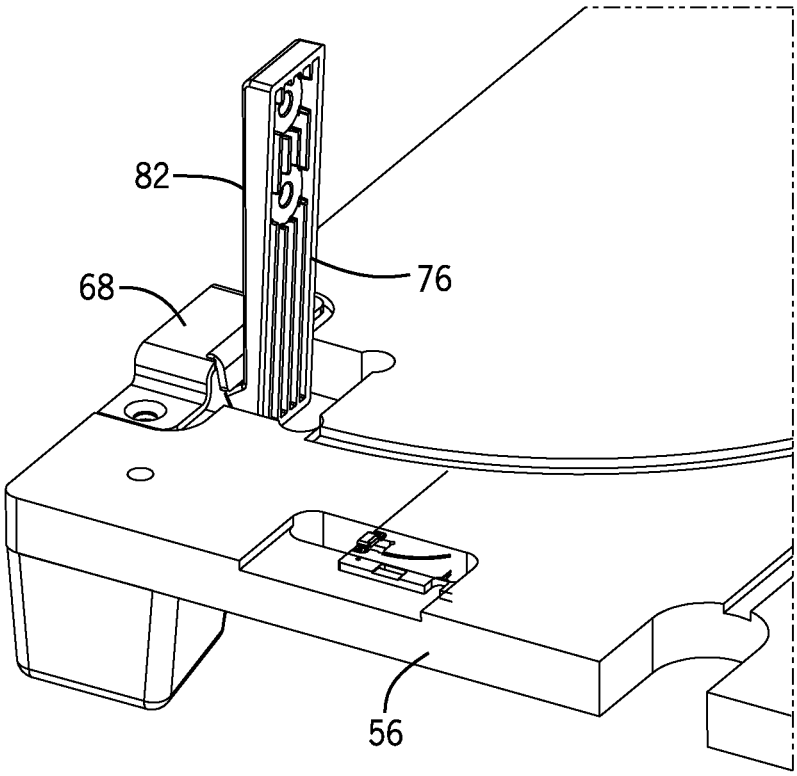
FIG. 7A is a perspective view of an alternate orientation of the front seat catch.
Figure 7B:
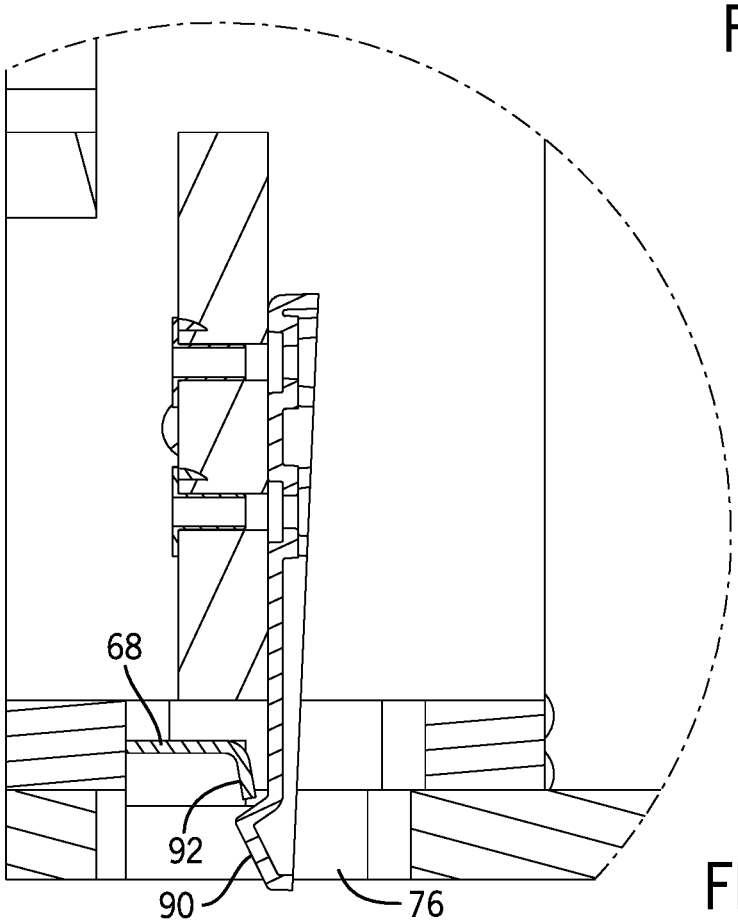
FIG. 7B is a side view of the alternate orientation shown in FIG. 7A.

FIGS. 7A and 7B illustrate an alternate orientation for the seat catches 68 relative to the access channel 76 formed in the base 56. In the alternate orientation, the access channel 76 is located in front of the seat catch, toward the front of the base.

Figure 8:
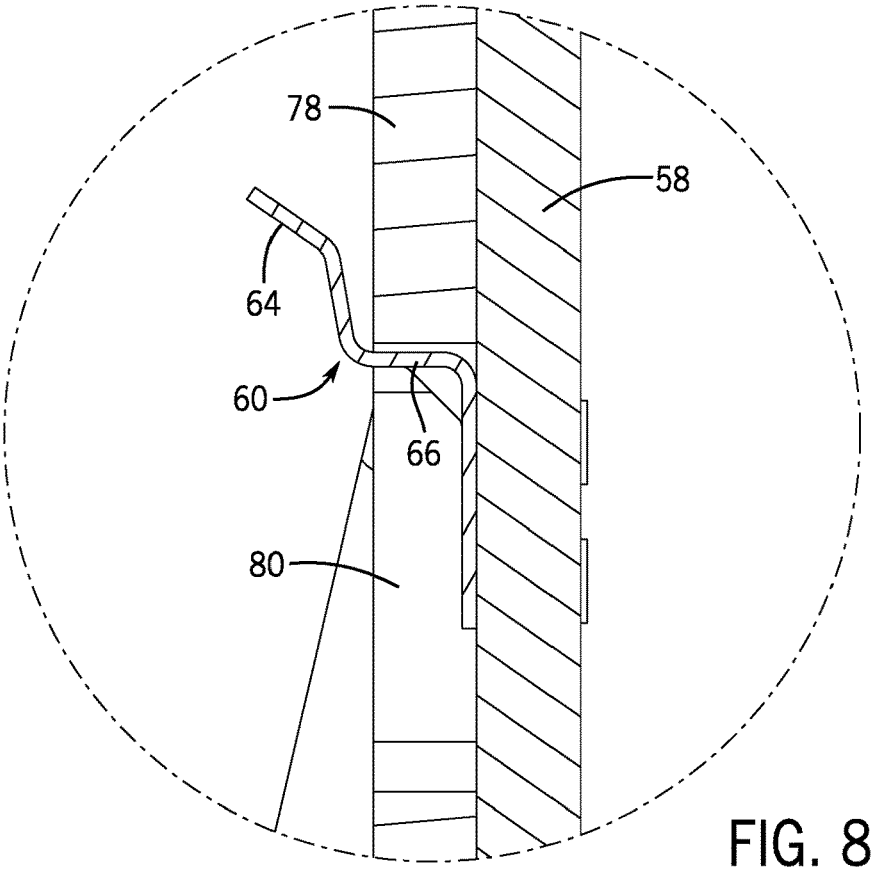
FIG. 8 is a magnified view taken along line 8-8 of FIG. 6.
Figure 9:
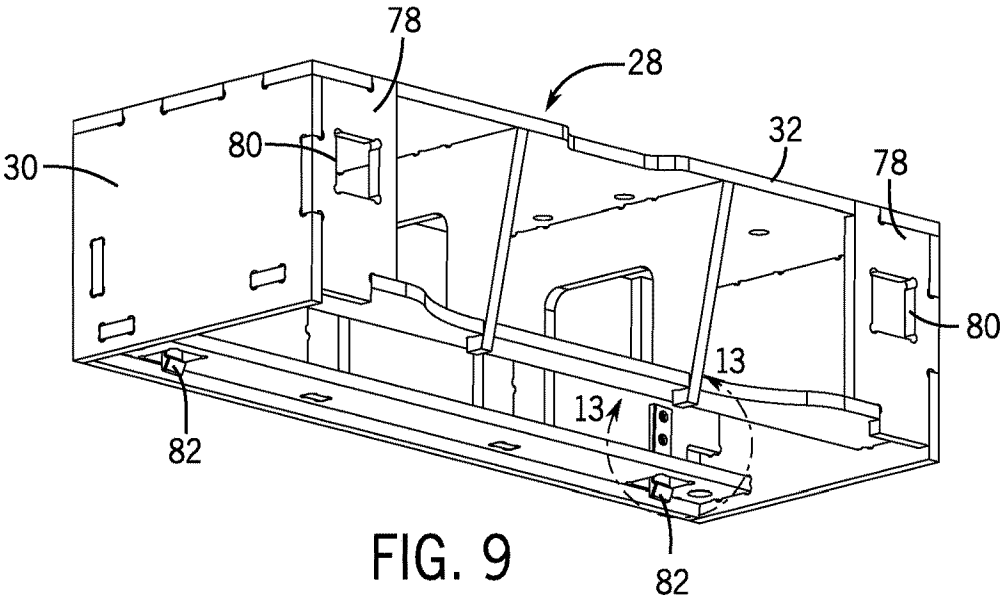
FIG. 9 is a bottom perspective view of the seat frame.

Referring now to FIGS. 6 and 9, the seat frame 28 includes a pair of vertical back panels 78 that are each connected to one of the side panels 30 and the top panel 32. Each of the back panels 78 includes an access opening 80. The access opening 80 is designed to receive the seat hook 60 (FIG. 10) when the seat is mounted to the lounge back. As shown in section view of FIG. 8, the engagement portion 64 of the seat hook 60 is received adjacent to the interior surface of the back panel 78 while the bend portion 66 extends through the access opening 80. In this manner, the seat hook 60 is able to hold the back panel 78 of the seat frame 28 in a desired position relative to the support wall 58 of the back frame 36.

Figure 13:
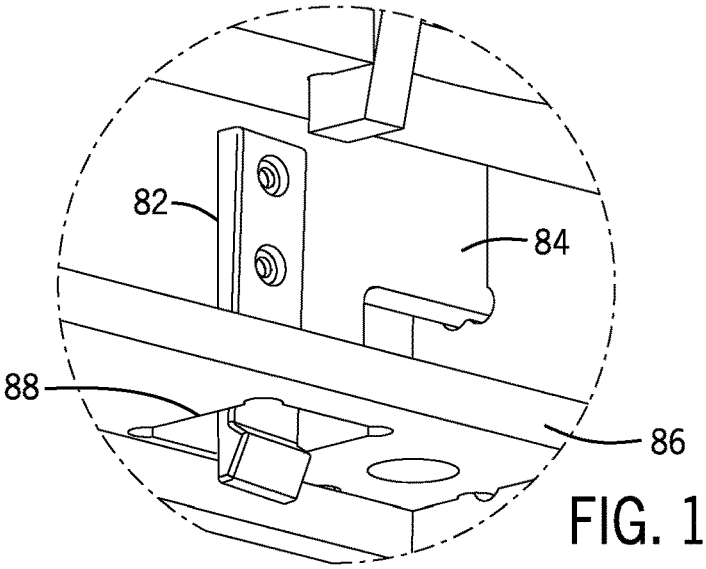
FIG. 13 is a magnified view taken along line 13-13 of FIG. 9.

Referring back again to FIGS. 6 and 9, the seat 18, and specifically the seat frame 28, further includes a pair of front seat hooks 82 that are each securely mounted to a support wall 84. As illustrated in the magnified view of FIG. 13, each of the front seat hooks 82 extends below a base wall 86 of the seat frame 28 through an opening 88. As can best be seen in FIG. 7, the front seat hook 82 includes a latch portion 90 that angles forward from the generally planar base. The latch portion 90 engages with the catch portion 92 of the front seat catch 68. The interaction between the front seat catch 68 and the front seat hook 82 holds the seat in place on the base 56 of the lounge back as is illustrated in FIG. 4. In the embodiment illustrated, the front seat hook 82 is a molded plastic component that is mounted to the support wall 84 by one or more connectors. However, it is contemplated that the front seat hook could be formed from other materials, such as metal, while operating within the scope of the present disclosure.

As described above, FIGS. 7A and 7B illustrate an alternate orientation for the pair of front seat hooks 82. In the alternate orientation, the front seat hooks are reversed such that the latch portion 90 angles backward away from the front of the base. In each orientation, the latch portion engages with the catch portion 92 of the front seat catch 68. The orientation of the front seat catch 68 and the front seat hooks 82 can be either of the two embodiments shown in the drawing figures.

Figure 14C:
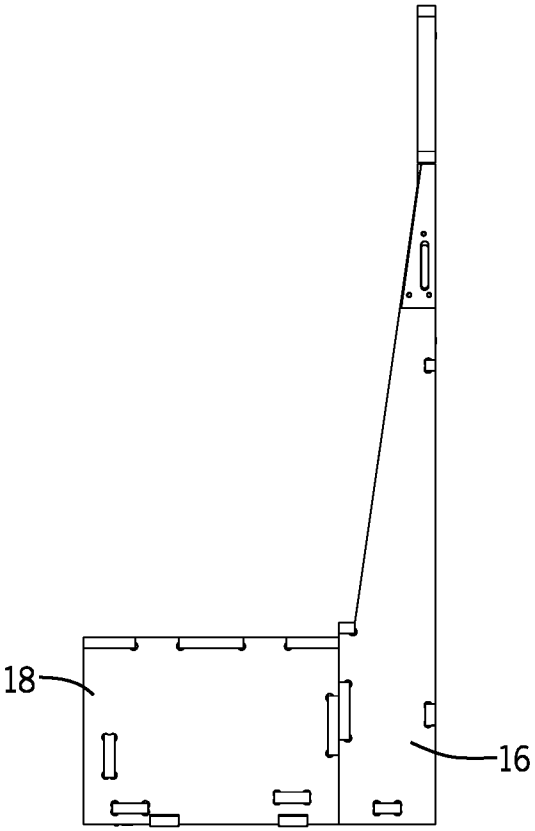
FIGS. 14A-14C are sequential side views showing the positioning of the seat on the lounge back and base.
Figure 14B:
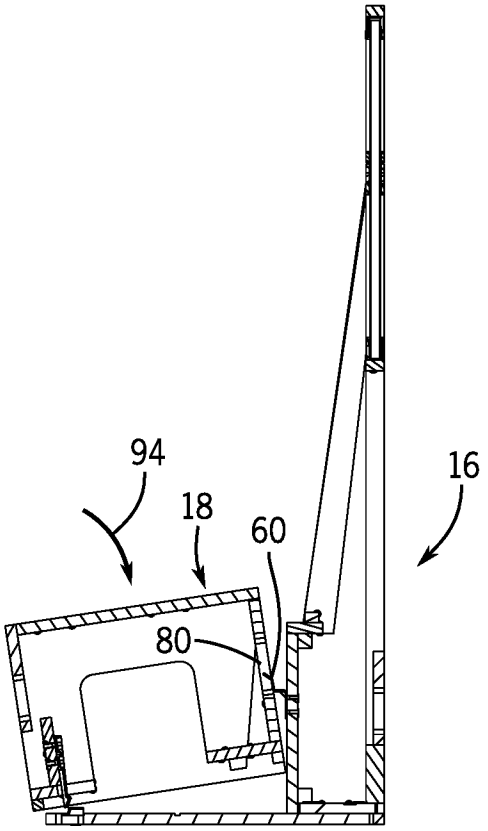
Figure 14A:
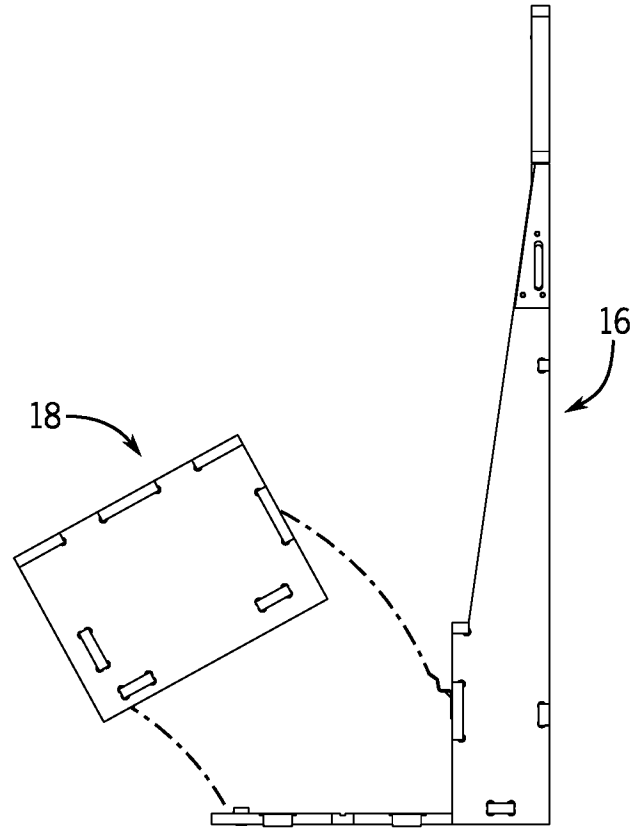

FIGS. 14A-14C illustrate one contemplated sequence for the mounting and securement of the seat 18 to the lounge back 16. Although FIGS. 14A-14C illustrate the attachment of the seat 18 to the lounge back 16, the reverse operation allows the seat 18 to be easily removed from the lounge back 16.

Figure 12:
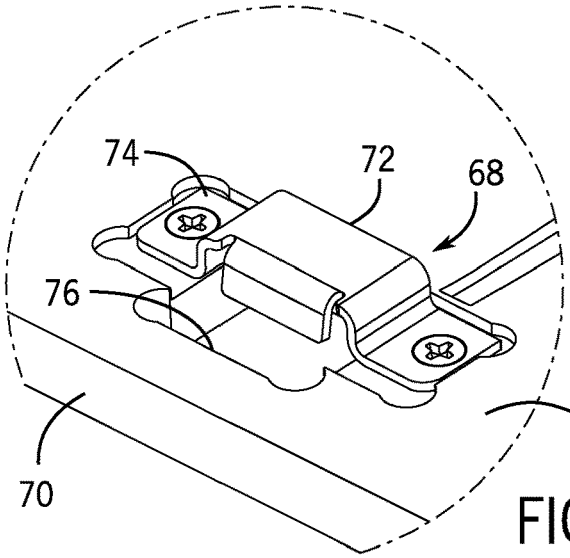
FIG. 12 is a magnified view taken along line 12-12 of FIG. 10.

As illustrated in FIG. 14A, the seat 18 is initially angled such that the front seat hook on the front end of the seat is received within the channel 76 positioned behind the seat catch 68, as best shown in FIG. 12. In this position, the front seat hook 82 is positioned behind the catch portion 92 of the front seat catch 68 as shown in FIG. 7.

Once in this position, the seat 18 is pivoted as shown by arrow 94 in FIG. 14B such that the back end of the seat rotates downward and the seat hook 60 enters into the access opening 80. Further rotation of the seat into the position shown in FIG. 14C causes the seat hook 60 to engage the back panel 78 of the seat frame as shown in FIG. 8. In the fully rotated position shown in FIG. 14C, the seat 18 is securely held in place relative to the lounge back 16.

The seat 18 can be removed by reversing the pivoting movement of the seat 18 relative to the lounge back 16. Specifically, the back end of the seat 18 is rotated upward and away from the lounge back 16 and the base 18. Such rotation allows the seat hook 60 to exit the access opening 80. In this manner, the seat frame can be pivoted away from and removed from the lounge back 16 as desired yet still provide a secure attachment between the two components during normal use. Removing the seat 18 from the lounge back 16 allows full access to the electrical wiring assembly joining the outlets when needed or during the initial assembly of the lounge furniture 14 from the separate furniture sections 12.

Referring back to FIGS. 3 and 10, the base 56 is designed to include a series of mitered channels 96 that create guides for electrical wires along the top surface of the base 56. As illustrated in FIG. 10, the mitered channels 96 include back channels 97 that extend to the back edge of the base, a longitudinal channel 99 that extend along the width of the base and front channels 98 directed toward where the receptacles are located on the seat. The back channels 97 allow for the connection to receptacles positioned as shown in FIG. 2.

Figure 15:
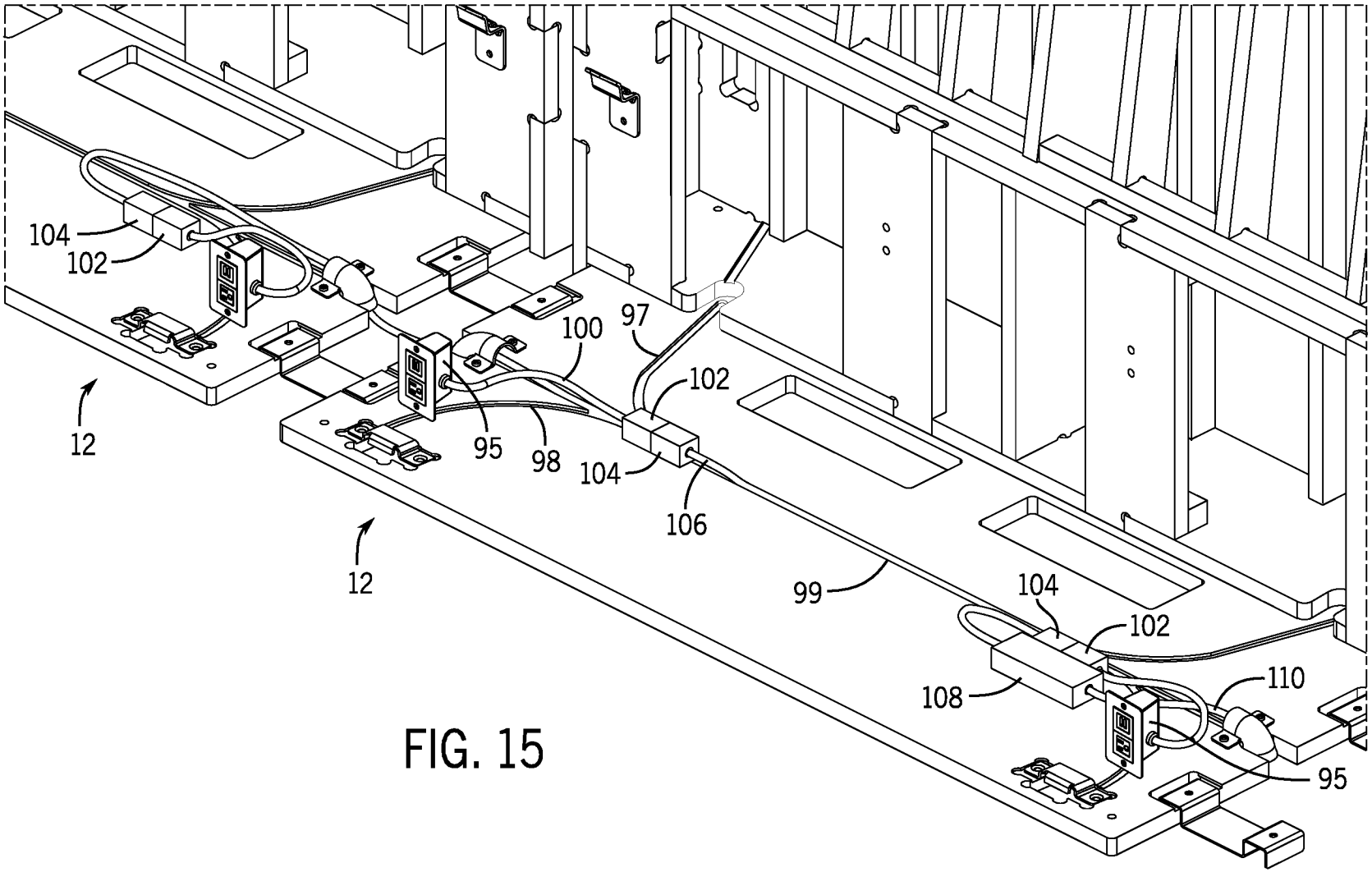
FIG. 15 is a view showing the electrical connections between adjacent lounge furniture sections.

FIG. 15 provides a magnified view of the electrical wiring assembly contained within joined sections of lounge furniture. As shown in FIG. 15, each of the outlet modules 95 includes a power cord 100 having a plug 102. The plug 102 connects to a mating plug 104 of a connecting wire 106. The connecting wire 106 includes a second plug 104 that can connect to the plug 102 of the adjacent outlet module 95. In the embodiment shown in FIG. 15, an infeed power module 108 is included in one of the furniture sections 12 and is connected to the main power supply through the connecting cord 110. The main power module 108 is thus the main module used to connect the joined sections of lounge furniture to a main power supply, such as shown by the cord 110 shown in FIG. 1.

As can be further understood in FIG. 15, adjacent lounge furniture sections 12 can be electrically connected to each other through interconnected plugs 102 and 104. The connecting wire passing between adjacent lounge furniture sections 12 passes through a cable routing elbow 111 positioned near each edge of the base. The cable routing elbows function to force the adjoining lounge module cabling closer to the floor to avoid pinching the cables with seat installation when rotating the seats back into the seating position. The cable routing elbows 111 are formed from molded plastic but could be other materials. As can be understood in FIG. 15, the electrical wiring and all of the wiring connections can be made when the seats of the individual lounge furniture sections 12 are either removed or in a pivoted position access position. This allows for an easier setup or maintenance after the lounge furniture has been installed.

As can be understood with reference to FIGS. 14A-14C, since each of the seats can be pivoted upwardly and away from the lounge back, the seat can be removed to provide access to the electrical wiring joining each of the lounge furniture sections and the individual receptacles associated with each. Such configuration allows for inspection, maintenance and installation of the electrical connection wires without having to disassemble the entire joined sections of lounge furniture.

FIGS. 19-22 illustrate an alternate method of joining two adjacent lounge furniture sections 12, especially in an embodiment in which the topper section is not included in the furniture section 12. In the embodiment shown in FIG. 22, a first section 12 is designed to include a latch bracket 120 while the adjacent furniture section 12 includes a receiving bracket 122. The brackets 120 and 122 are each attached to the side panel 38 by a series of connectors 124.

Figure 19:
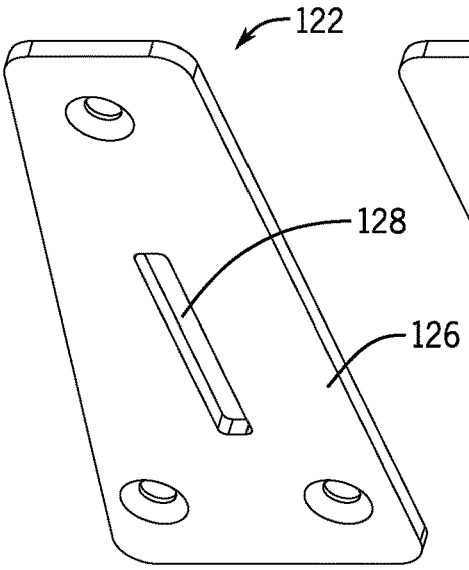
FIG. 19 is a perspective view of a receiving side bracket.

As shown in FIG. 19, the receiving bracket 122 includes a base plate 126 that includes a receiving slot 128. The receiving slot 128 extends over a portion of the length of the base plate and has a width designed to receive a portion of the latch bracket 120 shown in FIG. 20. In the embodiment shown, the receiving bracket 122 is formed from a metal material. However, it is contemplated that the receiving bracket 122 could be formed from a plastic material.

Figure 20:
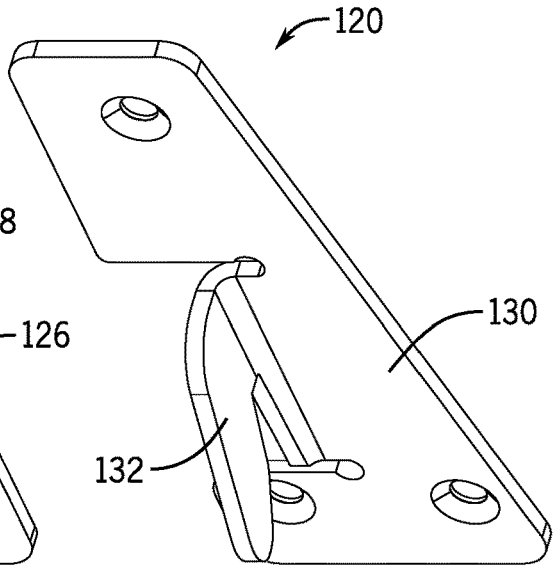
FIG. 20 is a perspective view of a latching side bracket.
Figure 21:
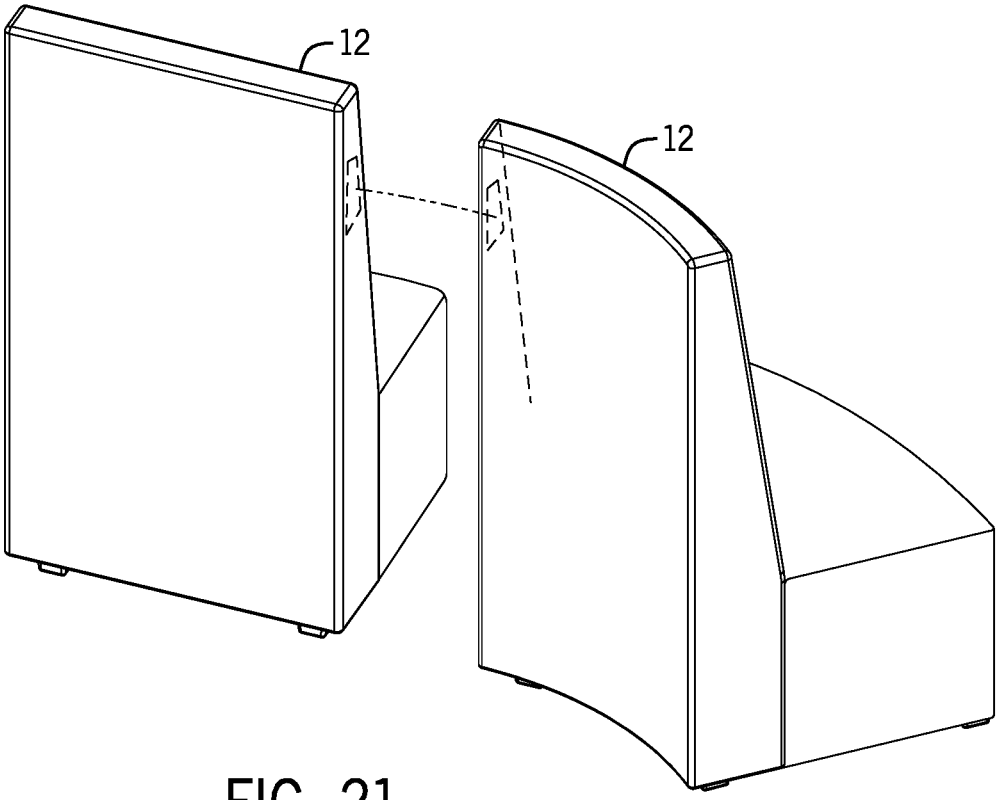
FIG. 21 is a rear perspective view of a pair of lounge furniture sections separated.
Figure 22:
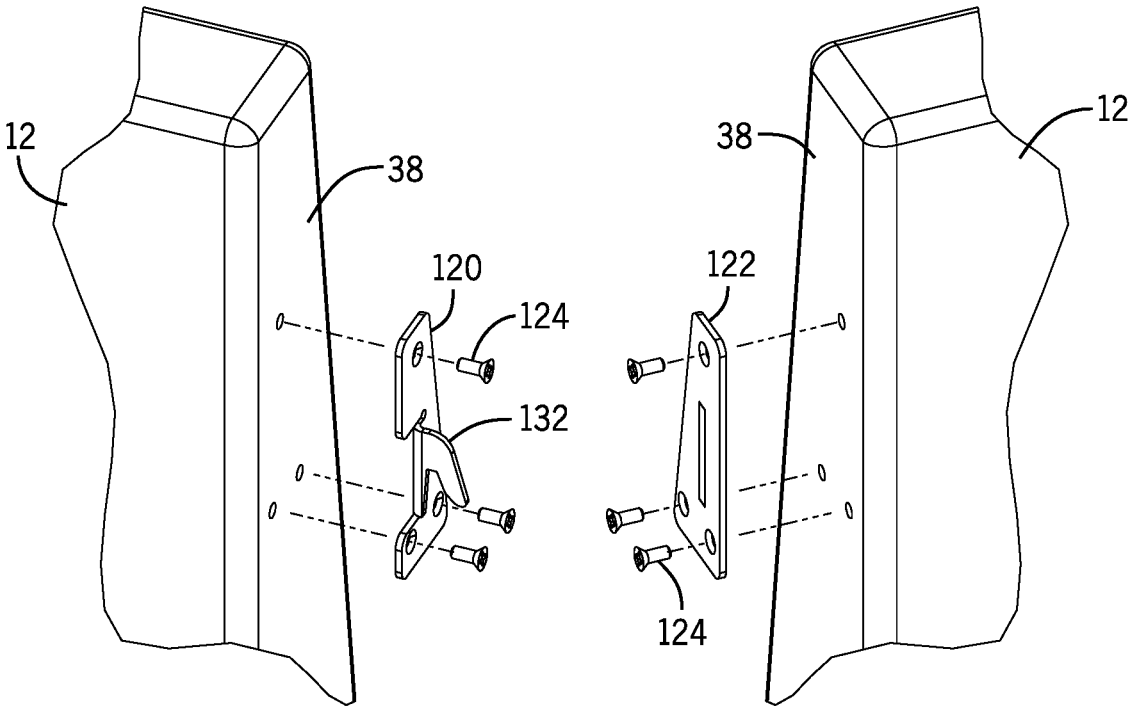
FIG. 22 is a magnified exploded view of the receiving and latching brackets.

As shown in FIG. 20, the latch bracket 120 also includes a base plate 130 that includes a latch finger 132. The latch finger 132 extends perpendicular to the base plate 130. The latch finger 132 has a width that is less than the width of the receiving slot of the receiving bracket 122 such that the latch finger 132 can be received and retained in the receiving slot 128. The engagement between the latch finger 132 of the latch bracket 120 and the receiving slot 128 of the receiving bracket 122 is used to hold the adjacent furniture sections in place relative to each other, especially in embodiments when the top ganger bracket is eliminated.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. Lounge furniture, comprising:

a plurality of independent furniture sections that can be separated from each other, each of the furniture sections including a lounge back, a seat and a base, wherein the seat and the lounge back are supported on the base and the seat is removable from the base to provide access to a top surface of the base;

at least one electrical outlet associated with each of the plurality of furniture section; and an electrical wiring assembly extending between the electrical outlets of each of the plurality of furniture sections, wherein the electrical wiring assembly is received on the top surface of the base of each of plurality of furniture sections and is concealed beneath the seat of the furniture section.

2. The lounge furniture of claim 1 wherein the at least one electrical outlet is located in a front wall of the base such that the electrical outlet is accessible from the front of the furniture section.

3. The lounge furniture of claim 1 wherein each seat includes at least one front seat hook that engages the base to hold the seat on the base.

4. The lounge furniture of claim 3 wherein the base includes a front seat catch positioned to receive and engage the at least one front seat hook when the seat is received on the base.

5. The lounge furniture of claim 3 wherein lounge back includes at least one seat hook, wherein the at least one seat hook of the lounge back is received in an access opening formed in the seat to secure the seat to the lounge back.

6. The lounge furniture of claim 5 wherein a back end of the seat is pivoted away from the lounge back to release the at least one seat hook to provide access to the electrical wiring assembly.

7. The lounge furniture of claim 6 wherein the at least one electrical outlet is located in a front wall of the base such that the electrical outlet is accessible from the front of the furniture section, wherein the electrical outlet pivots with the movement of the seat.

8. The lounge furniture of claim 1 further comprising at least one base ganger positioned between the bases of adjacent furniture sections to secure the adjacent furniture sections to each other.

9. The lounge furniture of claim 1 further comprising at least one backrest ganger positioned between the lounge backs of adjacent furniture sections to secure the adjacent furniture sections to each other.

10. The lounge furniture of claim 8 wherein the at least one electrical outlet is located in a front wall of the base such that the electrical outlet is accessible from the front of the furniture section.

11. Lounge furniture, comprising:

a plurality of independent furniture sections that can be separated from each other, each of the furniture sections including a lounge back, a seat and a base, wherein the seat and the lounge back are supported on the base and a back end of the seat is selectively pivotable away from the base to provide access to a top surface of the base;

at least one electrical outlet associated with each furniture section; and an electrical wiring assembly extending between the electrical outlets of the plurality of furniture sections, wherein the electrical wiring assembly is received on the top surface of the base of each of plurality of furniture sections and is concealed beneath the seat of the furniture section and accessible upon pivoting movement of the seat away from the base.

12. The lounge furniture of claim 11 wherein the at least one electrical outlet is located in a front wall of the base such that the electrical outlet is accessible from the front of the furniture section.

13. The lounge furniture of claim 11 wherein each seat includes at least one front seat hook that engages the base to hold a front end of the seat on the base.

14. The lounge furniture of claim 13 wherein the base includes a front seat catch positioned to receive and engage the at least one front seat hook when the seat is received on the base.

15. The lounge furniture of claim 13 wherein lounge back includes at least one seat hook, wherein the at least one seat hook of the lounge back is received in an access opening formed in the seat to secure the back end of the seat to the lounge back.

16. The lounge furniture of claim 15 wherein the back end of the seat is pivoted away from the lounge back to release the at least one seat hook to provide access to the electrical wiring assembly.

17. The lounge furniture of claim 11 further comprising at least one base ganger positioned between the bases of adjacent furniture sections to secure the adjacent furniture sections to each other.

18. The lounge furniture of claim 11 further comprising at least one backrest ganger positioned between the lounge backs of adjacent furniture sections to secure the adjacent furniture sections to each other.

19. The lounge furniture of claim 17 wherein the at least one electrical outlet is located in a front wall of the base such that the electrical outlet is accessible from the front of the furniture section.

* * * * *